United States Patent [19]

Phillips et al.

[11] Patent Number: 4,643,059

[45] Date of Patent: Feb. 17, 1987

[54] TAPE DISPENSER

[76] Inventors: Ian R. Phillips, 12 Garnet Street, Killara, New South Wales 2071; Robert H. Lodge, 30 Kirkstone Road, Wheeler Heights, New South Wales 2098; Alan A. Loveday, 1 Poate Place, Davidson, New South Wales 2085, all of Australia

[21] Appl. No.: 759,048

[22] Filed: Jul. 25, 1985

[30] Foreign Application Priority Data

Jul. 27, 1984 [AU] Australia ..... PG6258

[51] Int. Cl.[4] ..... B26D 5/22

[52] U.S. Cl. ..... 83/162; 30/124; 83/203; 83/649; 83/925 R; 128/303 R; 604/61

[58] Field of Search ..... 83/203, 649, 925 R, 83/162; 30/124, 241, 243; 128/303 R, 355; 604/57, 60–64; 227/76, 93–98

[56] References Cited

U.S. PATENT DOCUMENTS

| | | | |
|---|---|---|---|
| 3,386,634 | 6/1968 | Curry | 83/649 X |
| 3,948,128 | 4/1976 | Russell | 83/925 R |
| 4,447,223 | 5/1984 | Kaye et al. | 604/61 |
| 4,456,161 | 6/1984 | Russell | 227/95 X |

*Primary Examiner*—James M. Meister
*Attorney, Agent, or Firm*—Ladas & Parry

[57] ABSTRACT

A tape dispenser having a hollow body to receive a supply of medicated tape to be dispensed in predetermined lengths into the mouth of an animal, the tape dispenser is trigger operated and is provided with a barrel along which a delivery head moves, a predetermined length of tape is delivered into the barrel and severed from the supply by said delivery head, which predetermined length is then delivered into the mouth of the animal via the terminal end of the barrel.

10 Claims, 3 Drawing Figures

TAPE DISPENSER

The present invention relates to tape dispensers and more particularly but not exclusively to tape dispensers which deliver a medication in tape form into an animal's mouth.

It has been found advantageous to dispense animal medications in the form of a tape which is delivered into the animal's mouth. Accordingly, it is the object of the present invention to provide a tape dispenser which may be used to deliver a medication tape to the mouth of an animal.

There is disclosed herein a tape dispenser to deliver predetermined lengths of a medication into an animal's mouth, said tape dispenser comprising: a body to receive a supply of said tape and having an elongated delivery barrel having a terminal end from which said tape is dispensed, means to move the tape from said supply, in predetermined lengths, to said barrel, and dispenser means to sever each predetermined length of said tape when delivered to said barrel thus enabling dispensing of said predetermined length into the mouth of said animal from said terminal end of said barrel.

A preferred form of the present invention will now be described by way of example with reference to the accompanying drawings wherein.

Figure 1:
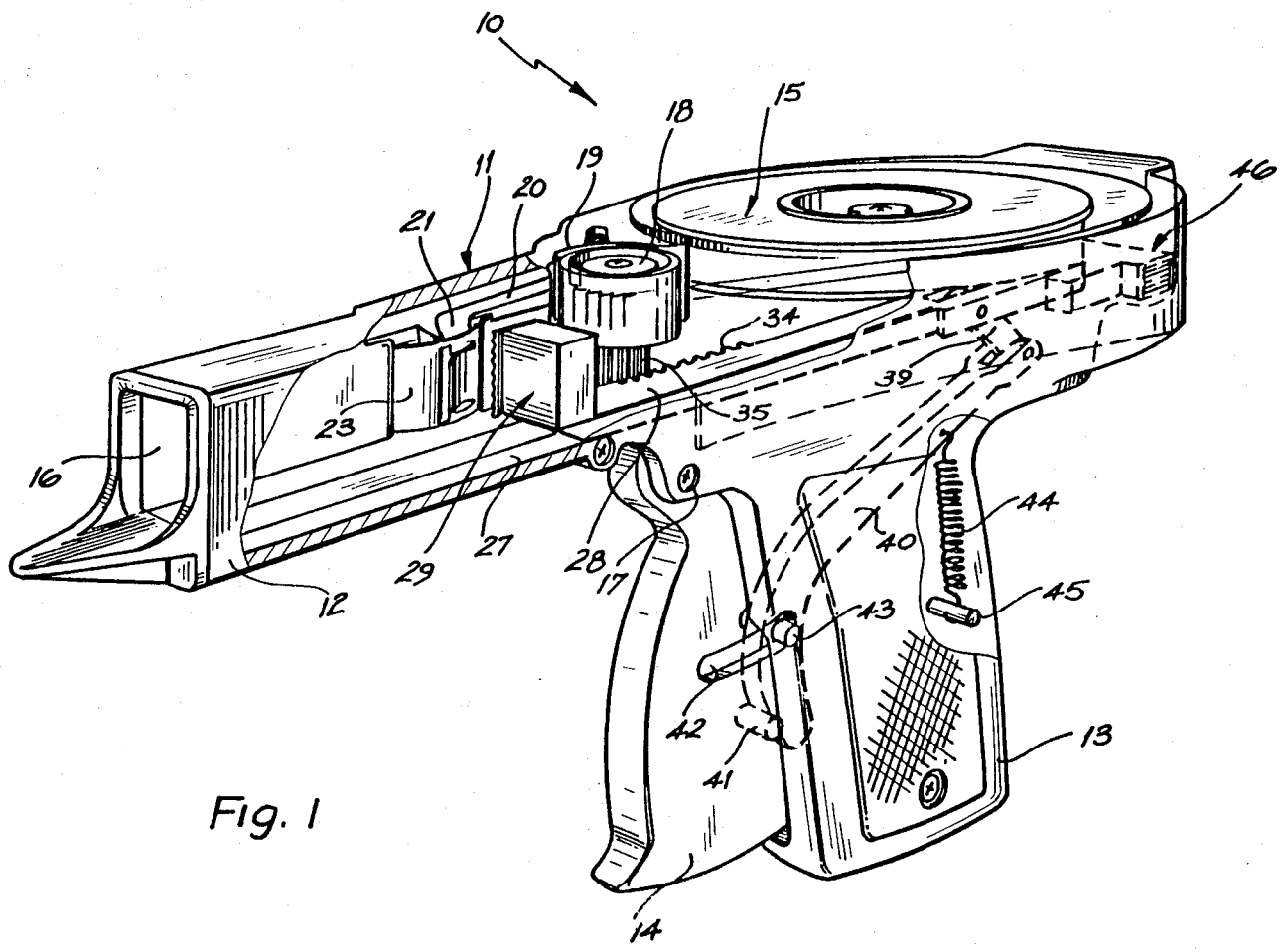
FIG. 1 is a schematic perspective view of a tape dispenser to deliver a predetermined length of tape containing a medication, the mouth of an animal.
Figure 2:
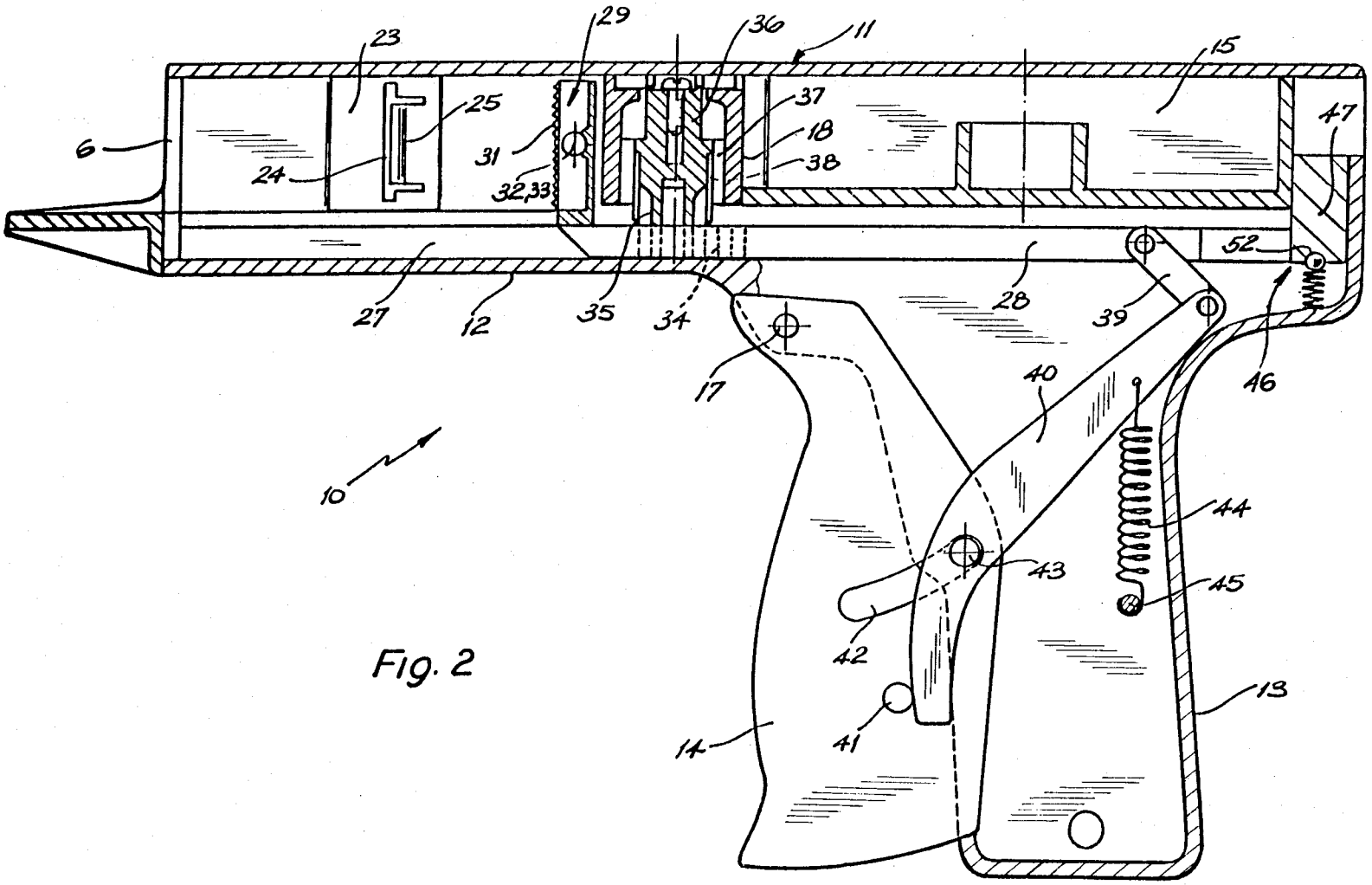
FIG. 2 is a schematic part sectioned side elevation of the dispenser of FIG. 1.
Figure 3:
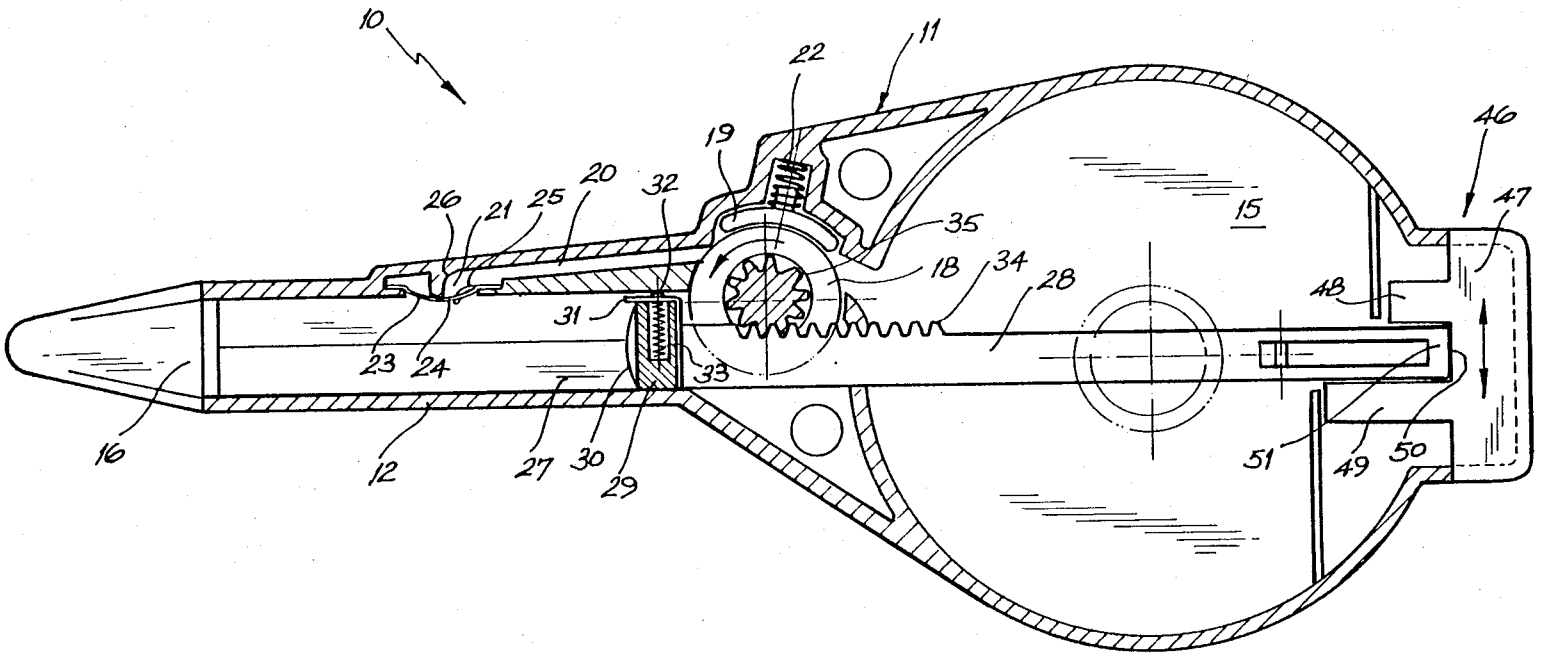
FIG. 3 is a schematic part sectioned plan view of the dispenser of FIG. 1.

In FIGS. 1 to 3 there is schematically depicted a tape dispenser 10 to deliver predetermined lengths of tape containing a medication into the mouth of an animal. The dispenser 10 has a body 11 providing a elongated barrel 12, a hand grip 13 and a trigger 14. The body 11 is provided with a cavity 15 which receives a bulk supply of medication tape in the form of a roll. The trigger 14 is gripped and moved by the user so that the dispenser 10 delivers through the aperture 16 the required length of tape.

The tape contained within the cavity 15 is fed to a feed roller 18 which cooperates with a friction pad 19 to deliver the tape along a channel 20. The channel 20 communicates with the interior of the barrel 12 by means of an aperture 21. The friction pad 19 is biased towards the feed roller 18 by means of a spring 22 so that the tape leaving the cavity 15 is sandwiched between the pad 19 and feed roller 18. Mounted in the barrel 12 at the aperture 21 is a guide plate 23 which is resiliently retained in position. The guide plate 23 defines a slot 24 through which the tape enters the interior of the barrel 12. The plate 23 is also provided with a guide tongue 25 which is arced and cooperates with the curved portion 26 of the channel 20 to direct the tape to the slot 24. Formed within the barrel 12 is a guide track 27 which slidably receives a push rod 28 so that the rod 28 may move longitudinally of the track 27. Mounted on the leading portion of the rod 28 is a delivery head 29 which protects the interior of the barrel 12 and passes the aperture 21 upon longitudinal movement of the rod 28. The delivery head 29 includes a leading portion 30 of material to inhibit the tape adhering to the delivery head, and a blade 31. The blade 31 has a serrated leading edge 32 and passes adjacent the aperture 21 so as to sever a portion of tape extending therethrough. Also mounted on the delivery head 29 is a bearing member 32 which is biased together with the blade 31 to a position as depicted in FIG. 5 by a spring 33.

Formed on the rod 28 is a rack gear 34 which meshingly engages a pinion gear 35 which drives the feed roller 18. The pinion gear 35 is formed integral with a drive shaft 36 located within the feed roller 18. The drive shaft 36 is formed with a plurality of pawls 38 which cooperate with a plurality of ratchet teeth 37 formed on the interior surface of the roller 18. The pawls 38 are resiliently radially and angularly deflectable in one direction so that the roller 18 is only fed in a direction whereby the tape is delivered to the channel 20. Accordingly, with reference to FIG. 3, the roller 18 is only driven when the rod 28 moves from left to right. That is to say, the roller 18 is only driven when the delivery head 29 is being retracted. The pad 19 aids in restraining return of the roller 18. The rack gear 34 is of a predetermined length so as to be engaged with the pinion gear 35 when the delivery head 29 is spaced inwardly from the recess 21. Upon the delivery head 29 reaching the recess 21 and being spaced towards the aperture 16, the rack gear 34 ceases to be meshingly engaged with the pinion gear 35. Accordingly, as the delivery head 29 is allowed to retract, the delivery head 29 passes the recess 21 and the rack gear 34 again meshingly engages the pinion gear 35. As the delivery head 29 further retracts the roller 18 is driven to thereby deliver a further predetermined length of tape to the interior of the barrel 12.

Pivotally attached to the rod 28 is an operating link 39 which is pivotally attached to an operating lever 40. The lever 40 is mounted on the trigger 14 by means of a pin 41 and a slot 42. The lever 40 is provided with a pin 43 which enters the slot 42. Also attached to the lever 40 is a spring 44 which is attached to a projection 45. Upon operation of the trigger 14, the lever 40 causes movement of the link 39 to cause longitudinal movement of the rod 28.

Mounted at the rear of the body 12, is an adjustment assembly 46 which can be manipulated by a user to determine the length of tape dispensed by the dispenser 10. The adjustment assembly 46 includes an adjustment member 47 which is movable transverse of the longitudinal direction of extension of the rod 28. The adjustment member 47 is provided with two projections 48 and 49 which cooperate to define a recess 50. In FIG. 3, the rod 28 is depicted as having its free end 51 located in the recess 50. In this particular position, the maximum length of tape is delivered by the dispenser 10. However, the adjustment member 47 may be moved transversely of the rod 28 to selectively bring into alignment either the projection 48 or the projection 49 with the end 51 of the rod 28. If the projection 48 is brought into alignment with the end 51, then a shorter length of tape is delivered by the dispenser 10. However, if the projection 47 is brought into alignment with the rod 28, then a still shorter length of tape is dispensed by the dispenser 10. The length of tape dispensed by the dispenser 10 is determined by the amount of travel of the rack gear 34. These three positions of the adjustment member 47 are defined by a spring loaded ball 52 which is received within three recesses formed in the adjustment member 47.

In operation of the abovedescribed dispenser 10, the dispenser 10 is loaded with a roll of medication tape. The tape is fed to the roller 18 and the trigger 14 activated so as to pass the tape along the channel 27 to the aperture 21. It should be particularly noted that the roller 18 is only activated upon rearward movement of the rod 28, that is movement of the trigger 14 from the operate position to the rest position depicted in FIG. 3. Accordingly, due to the length of the rack gear 34, the dispensing head 29 is allowed to pass aperture 21 before further tape is delivered to the interior of the barrel 12. Accordingly, when the trigger 14 is again depressed by the operator, the blade 31 passes the slot 24 to sever a portion of tape to be delivered by the dispensing head 29. Upon a portion of tape being severed, further movement of the rod 28 moves the dispensing head 29 towards the aperture 16 so that the severed portion of tape is delivered therethrough.

It has been found desirable to space the position of delivery of the tape into the barrel 12 from the terminal end.

What we claim is:

1. A tape dispenser to deliver predetermined lengths of a medication in tape form into an animal's mouth, said tape dispenser comprising: a body to receive a supply of said tape and having an elongated delivery barrel having a terminal end from which said tape is dispensed, roller means to move the tape from said supply, in predetermined length, into said barrel, said roller means including at least one driven roller having a rotational axis transverse of the tape, and a delivery head including blade means to sever each predetermined length of said tape from said supply of tape when delivered into said barrel thus enabling dispensing of said predetermined length into the mouth of said animal from said terminal end of said barrel.

2. The dispenser of claim 1, wherein blade means includes a blade movable along said barrel from a retracted position to a dispensing position by movement of said delivery head, with the predetermined length of tape being delivered to said barrel intermediate the retracted and dispensing positions of said blade.

3. The dispenser of claim 1, wherein the means to move the tape from said supply includes an operator manipulated trigger mounted on the body, and said roller frictionally engages said tape to move same upon rotation of the roller, and drive means coupling the trigger and roller, the drive means including a lost motion means so that the roller is only driven in one direction to move the tape from said supply to said barrel.

4. The dispenser of claim 3, wherein said drive means is adapted to drive said roller so as to deliver said predetermined length of tape upon a single actuation of said trigger.

5. A tape dispenser to dispense medicated tape into the mouth of an animal, said dispenser comprising: a body to receive and support a supply of said tape, said body having an elongated barrel with a terminal end from which a predetermined length of tape is dispensed into the animal's mouth, a tape delivery passage formed in said body and extending from said supply to said barrel, a driven roller partly defining said passage so as to engage the tape when located therein to move the tape along said passage from said supply to said barrel, a delivery head mounted within said barrel and movable therealong from a retracted position to a delivery position adjacent said barrel terminal end, an aperture in said barrel intermediate the retracted and dispensing positions of said delivery head and providing an end of said passage, the delivery head having a blade which passes adjacent said aperture to sever the predetermined length of tape protruding therefrom into said barrel, a pushrod supporting and extending from said delivery head towards said retracted position, an operator manipulated trigger mounted on said body, drive means drivingly connecting said pushrod with said trigger to cause movement of said delivery head between the retracted and dispensing positions thereof, said drive means also connecting said roller with said trigger so as to cause rotation of said roller to deliver said predetermined length into said barrel, said drive means being adapted to drive said roller in a single direction so as to move said tape along said passage from said supply to said aperture.

6. The dispenser of claim 5 wherein said drive means includes a lever pivotally mounted intermediate its ends, one end of said lever being engaged by said trigger so that said lever is caused to pivot upon operation of said trigger, the other end of said lever being pivotally coupled to said pushrod by means of a link so that said pushrod is moved by said lever upon actuation of said trigger.

7. The tape dispenser of claim 6, wherein said drive means further includes a rack gear formed on said pushrod and a pinion gear drivingly connected to said roller, and wherein said rack gear and pinion gear are meshingly engaged so that said roller is driven by movement of said pushrod.

8. The tape dispenser of claim 7, wherein said drive means includes one-way drive means coupling said roller with said pinion gear so that said roller is only driven by said pinion gear when said pushrod is moved in a predetermined direction.

9. The tape dispenser of claim 8, wherein said roller is driven by said pushrod when said delivery head is moved from said dispensing position to said retracted position.

10. The tape dispenser of claim 5, further including adjustment means to predetermine the length of travel of said piston rod to thereby determine the length of said predetermined length of tape.

* * * * *